United States Patent [19]

Nobuyoshi et al.

[11] Patent Number: 5,061,358

[45] Date of Patent: Oct. 29, 1991

[54] INSOLUBLE ANODES FOR PRODUCING MANGANESE DIOXIDE CONSISTING ESSENTIALLY OF A TITANIUM-NICKEL ALLOY

[75] Inventors: Ryoichi Nobuyoshi; Kazuhiro Taki, both of Kanagawa, Japan

[73] Assignee: Nippon Mining Co., Ltd., Tokyo, Japan

[21] Appl. No.: 535,271

[22] Filed: Jun. 8, 1990

[51] Int. Cl.[5] ..... G25B 11/10

[52] U.S. Cl. ..... 204/290 R; 204/293

[58] Field of Search ..... 204/290 R, 290 F, 293; 420/417

[56] References Cited

U.S. PATENT DOCUMENTS

| | | | |
|---|---|---|---|
| 2,608,531 | 8/1952 | Fox | 204/105 M |
| 3,033,775 | 5/1962 | Chevigny et al. | 204/196 |
| 3,169,085 | 2/1965 | Newman | 148/11.5 |
| 3,957,600 | 5/1976 | Ives et al. | 204/105 R |
| 4,363,706 | 12/1982 | Williams et al. | 204/105 R |
| 4,528,084 | 7/1985 | Beer et al. | 204/290 F |
| 4,663,010 | 5/1987 | Debrodt et al. | 204/290 R |
| 4,744,878 | 5/1988 | Riggs, Jr. | 204/293 |

FOREIGN PATENT DOCUMENTS

| | | | |
|---|---|---|---|
| 0031840 | 2/1984 | Japan | 420/417 |
| 1-165785 | 2/1989 | Japan . | |
| 1-176085 | 7/1989 | Japan . | |
| 1076496 | 10/1982 | U.S.S.R. . | |

OTHER PUBLICATIONS

Riskin et al.; "Anodic Behavior of Titanium and the Alloy of Ti and 2% Ni in Neutral and Alkaline Chloride Solutions"; pp. 361-363; 1980; Plenum Publishing Corporation.

Hansen, Constitution of Binary Alloys, McGraw-Hill Book Co. (1958).

Sedriks et al., Electrochemical Behavior of Ti-Ni Alloys in Acidic Chloride Solutions, vol. 28, No. 4, Apr. 1972; pp. 137-142.

Machida et al., Amorphous Ni-Ti and Ni-Zr Alloys for Water Electrolysis Cathode Materials, Bull. Chem. Soc. Japan, 56, Nov. 1983, pp. 3393-3399.

*Primary Examiner*—John F. Niebling

*Assistant Examiner*—Kathryn Gorgos

*Attorney, Agent, or Firm*—Seidel, Gonda, Lavorgna & Monaco

[57] ABSTRACT

There is provided an insoluble anode for producing manganese dioxide by electrolysis characterized in that the surface layer or the entire anode is made of a titanium alloy of from 0.5 to less than 15 percent by weight of nickel, the remainder being titanium and unavoidable impurities. The titanium alloy preferably has thereon $Ti_2Ni$ particles 300 μm or finer in size dispersed uniformly at the rate of at least 10,000 particles per square millimeter of the anode surface area, whereby the growth of a passive state film is prevented.

22 Claims, No Drawings

INSOLUBLE ANODES FOR PRODUCING MANGANESE DIOXIDE CONSISTING ESSENTIALLY OF A TITANIUM-NICKEL ALLOY

BACKGROUND OF THE INVENTION

This invention relates to insoluble anodes for producing electrolytic manganese dioxide.

Electrolytic manganese dioxide is used chiefly as the active material of dry cells or batteries. This manganese dioxide is usually manufactured by electrolysis from an aqueous sulfuric acid-manganese sulfate solution containing from 0.5 to 1.0 mole manganese sulfate and from 0.2 to 0.6 mole free sulfuric acid per liter of the solution.

The aqueous solution upon electrolysis with a direct current on the order of 0.8 $A/cm^2$ deposits manganese dioxide on the anode. Once the deposit has built up to a certain extent, it is peeled off and collected as product manganese dioxide. During the process, hydrogen evolves from the cathode.

Titanium has recently come into use as the anode material for the manufacture of electrolytic manganese dioxide. The reason is that the titanium electrode has outstanding corrosion resistance, specific strength, and workability and also precludes anode-induced contamination of electrolytic manganese dioxide and yields a high quality product.

One problem associated with the use of titanium as the anode for the above process has been the growth of the passive state film on the surface with the increase in current density; it raises the bath voltage accordingly, until the flow of current becomes no longer possible. To avoid this problem, it has been necessary to keep the current density within the range around 0.8 $A/dm^2$.

Current density, thus, has a direct bearing upon productivity in the electrolysis industry. The electrolytic cell employed being the same, the higher the current density the larger would be the scale of production that is made feasible. Also, the output being the same, the electrolytic cell could be made smaller in size as the current density .increases, reducing the investment in the electrolytic cell to an economical advantage.

Titanium is used as anodes not merely for the production of electrolytic manganese dioxide but also for other applications. With the latter, too, the difficulty is that increased current density induces the growth of a passive state film on the surface with eventual interruption of current flow. To avoid this, modern practice favors plating of the anodes with a noble metal such as platinum.

However, the plating treatment using an expensive noble metal casts a heavy financial burden on the manufacturer. It, thus, presents a major obstacle in the way of the extensive commercial acceptance of the plated anodes.

With these in view, this invention is aimed at providing at low cost a titanium alloy anode which can replace existing titanium anodes and is characterized by the capability of carrying a greater current density.

SUMMARY OF THE INVENTION

The present invention is based upon our discovery, made after intensive research, that titanium containing nickel, preferably in the form of $Ti_2Ni$ precipitated and dispersed under specific conditions, gives favorable results.

The invention thus provides:

1. an insoluble anode for producing manganese dioxide by electrolysis characterized in that the surface layer or the entire anode is made of a titanium alloy of from 0.5 to less than 15 percent by weight of nickel, the remainder being titanium and unavoidable impurities; and 2. an insoluble anode for producing manganese dioxide by electrolysis characterized in that the surface layer or the entire anode is made of a titanium alloy of from 0.5 to less than 15 percent by weight of nickel, the remainder being titanium and unavoidable impurities, said titanium alloy having thereon $Ti_2Ni$ particles 300μm or finer in size dispersed uniformly at the rate of at least 10,000 particles per square millimeter of the surface area, whereby the growth of a passive state film is prevented.

In preferred embodiments of the invention:

(A) the surface roughness, Rmax, is 100 μm or above;

(B) the yield strength is 30 $kgf/mm^2$ or above, and the Vickers hardness 150 or above; and (C) the flatness is 6 mm or less per meter.

DETAILED DESCRIPTION OF THE INVENTION

In the manufacture of electrolytic manganese dioxide, the objective manganese dioxide deposits on the anode surface with the progress of electrolysis. As long as a low current density is used, no voltage increase takes place even with an anode of pure titanium, as opposed to the case where nothing deposits on the insoluble anode, such as in electroplating or electrolytic winning. It is for this reason that pure titanium, ordinarily unusable as an insoluble anode, can be employed as such in the manufacture of electrolytic manganese dioxide. Nevertheless, the current density must be kept below 0.8 $A/dm^2$, at most 1.0 $A/dm^2$, for a higher density would cause a gradual rise of the bath voltage with the progress of electrolysis.

This upper limit of current density can be increased by alloying titanium with nickel.

In accordance with the invention, 0.5 percent by weight or more of nickel is added to titanium.

Generally, there are three intermetallic compounds of titanium and nickel: $Ti_2Ni$, TiNi, and $TiNi_3$. With these compounds it has been found that no increase in bath voltage is observed when current is flowed through each as an anode. Since an insoluble anode must also not dissolve out component metal into the bath, the compounds were all tested with various solutions for corrosion and positive polarization behavior. The results showed that, out of $Ti_2Ni$, TiNi, and $TiNi_3$, the first-mentioned $Ti_2Ni$ performed best. Even in strongly acidic aqueous solutions, $Ti_2Ni$ alone permitted the flow of high density current without any component metal dissolution, up to the oxygen-generating potential.

Thus, $Ti_2Ni$ has proved to possess very desirable properties as an insoluble anode. However, it is too brittle an intermetallic compound which renders the manufacture of the anode difficult. Another disadvantage is that in environments where oxygen, chlorine, and other gases are produced by long-period electrolysis, the impact of gas evolution causes the $Ti_2Ni$ to come off. Our further research has revealed that when Ti and $Ti_2Ni$ are allowed to coexist, Ti makes up for the brittleness of the compound and keeps the latter from coming off. There is no danger of titanium dissolving out, because a passive state film is formed on its surface, enabling the remaining $Ti_2Ni$ surface to function well as an insoluble anode. It the $Ti_2Ni$ proportion is too small, a high current density is not attained; hence the lower limit of 0.5 % by weight is specified for Ni.

In preferred embodiments of the invention, $Ti_2Ni$ is deposited under specific conditions.

As stated above, $Ti_2Ni$ is highly corrosion-resistant (superior in this respect to pure titanium,) and unlike pure titanium it causes no bath voltage rise due to the formation of an oxide film with the flow of a large current. Thus, we have found that it permits the flow of more current without the danger of corrosion even in quite adverse, corrosive environments. In spite of this, $Ti_2Ni$ is so brittle that when used alone it is difficult to work, and is practically impossible to employ as an electrode for industrial application. We have now successfully overcome the brittleness of the compound by adding nickel to titanium and dispersing $Ti_2Ni$ very finely and homogeneously into titanium. In this way, an anode has now been perfected which permits the flow of far more current than pure titanium does.

The $Ti_2Ni$ particles on the anode surface are desired to be at most 300 μm in diameter, because larger particles will fall off the anode surface during actual operation. Also, uniform dispersion of the $Ti_2Ni$ particles is a preferred requirement. If the dispersion is nonuniform, uneven current flow will result from the irregular distribution of the particles on the anode surface, leading to a nonuniform growth rate of manganese dioxide. In order to attain a sufficiently high current density, it is desirable that the $Ti_2Ni$ particles are present at the rate of 10,000 or more per square millimeter of the surface.

The manufacture of such an anode is, for example, by nickel plating of titanium surface followed by thermal diffusion to produce $Ti_2Ni$ on the surface. Alternately, it is possible to prepare $Ti_2Ni$ by melting, grinding it into powder, scattering the powder over a titanium surface, bonding the $Ti_2Ni$ to the titanium surface by heat treatment, and finishing the anode by the combination of rolling plus heat treatment. A considerable simpler approach involves alloying titanium and nickel followed by proper rolling and heat treatment. Anodes for producing manganese dioxide usually take the form of sheets 3 to 6 mm thick, and therefore, an alloy must be made which is workable enough to be rolled down to the above thickness range with good yield. To this end, the alloy is required to contain no more than 15 percent by weight nickel.

For the manganese dioxide-producing anode, it is essential that electrolytic manganese dioxide deposit on the surface during the course of electrolysis. With ordinarily rolled sheets, it has been found that the electrolytically deposited manganese dioxide tends to come off. To avoid the exfoliation, it is now proposed to use a surface roughness, Rmax, of at least 100 μm. The electrolytic manganese dioxide that has deposited after the electrolysis must be removed, e.g., by hammering of the anode or mechanical stripping. This can cause bending or denting of the anode to insufficient strength or hardness. It is for this reason that under the invention the anode is preferably required to have a yield strength of 30 $kgf/mm^2$ or more and a Vickers hardness of 150 or more.

The anode for manganese dioxide usually must be spaced a certain distance from the cathode. If it is warped or curled, the growth of electrolytic manganese dioxide varies with the location on the anode surface; in an extreme case, shorting can occur. For this reason, the warping or curling must be restricted. Under the invention, a flatness of 6 mm or less per meter is desired.

For the purposes of the invention, the desired properties of the material as an insoluble anode need only be imparted to the electrode surface. There is no special limitation to the electrode substrate. For example, copper with good electrical conductivity may be chosen as the substrate and coated with the material of the invention. The combination will advantageously prevent the heat generation of the electrode with Joule heat and avoid power loss.

The coating material of the invention should be 0.1 μm or thicker. If it is less than 0.1 μm thick, long-period flow of current will cause Joule heat, anodizing, etc. This will expose some substrate surface, leading to serious melting of the particular region.

The invention will be better understood from the following description of the examples thereof.

EXAMPLES

Pure nickel was added in varying proportions to commercially available sponge titanium, and ingots were made by vacuum arc melting. The number of particles of the $Ti_2Ni$ that emerged on the surface was varied by many different heat treatment and rolling conditions. The products were used as test specimens.

The evaluation method used was as follows. Galvanostatic electrolysis was carried out in the same solution as used in actual operation, so as to form a manganese dioxide deposit on the surface of each test specimen. The bath voltage rise during the process was observed determine the maximum current density the specimen could withstand. The criterion adopted was: when more than 100 hours were required before the bath voltage exceeded 7 V, it was considered that manganese dioxide could be made without difficulty at that current density.

Table 1 summarizes the results of measurements of the time periods required for bath voltage rise when manganese dioxide electrolysis was performed using anodes with varied numbers of $Ti_2Ni$ particles on the titanium surface. The number of $Ti_2Ni$ particles was obtained by counting the particles in ten locations on 50 by 50 μm area portions of the specimen surface under a scanning electron microscope (SEM), and then averaging the counts. As can be seen from Table 1, the presence of more than 10,000 $Ti_2Ni$ particles permits the flow of more current than permitted by pure titanium. Deposition of an even larger number of the particles makes it possible to pass far more current in a stable way.

Table 2 compares the workability of titanium-base alloys containing varied proportions of nickel. It should be clear that the rolling properties deteriorate sharply as the nickel content increases. Particularly when the nickel content exceeds 15 percent by weight, the alloy becomes practically impossible to roll, hot or cold. Hence, the upper limit of the nickel content is 15 percent by weight.

Table 3 compares the degree of adhesion of electrolytic manganese dioxide deposited on the surface of test specimens of anodes with varied surface roughnesses. It will be appreciated that manganese dioxide will not adhere soundly to the surface unless the roughness is more than 100 μm.

It has been confirmed that the manganese dioxide produced using an electrode made by the process of the invention is superior in quality.

An additional advantage is that a high current density may be employed when the electrolysis of manganese dioxide is performed with the electrode of the present invention. If, however, the current density is not increased but kept the same, the bath voltage may be lowered with respect to the bath voltage which would be utilized for a conventional electrode comprising titanium alone.

TABLE 1

Results of measured time periods required for bath voltage rise with varied numbers of $Ti_2Ni$ particles on titanium surface

| Number of $Ti_2Ni$ particles/mm$^2$ | Current Density (A/cm$^2$) 1.0 | 1.2 | 1.4 | 1.6 | 1.8 |
|---|---|---|---|---|---|
| 0 (pure Ti) | ○ | x | x | x | x |
| 1000 | ○ | x | x | x | x |
| 8300 | ○ | x | x | x | x |
| 10500 | ○ | Δ | x | x | x |
| 83000 | ○ | ○ | ○ | Δ | x |
| 169000 | ○ | ○ | ○ | ○ | ○ |

○ = The bath voltage did not exceed 7 V for over 100 hours.
Δ = The bath voltage exceeded 7 V in 50–100 hours.
x = The bath voltage exceeded 7 V within 50 hours.

TABLE 2

Relationship between the nickel content in titanium and workability (containing 0.04 wt % Fe and 0.08 wt % $O_2$)

| Ni content (wt %) | Hot workability | Cold workability |
|---|---|---|
| 0 (pure Ti) | ○ | ○ |
| 0.1 | ○ | ○ |
| 1.2 | ○ | Δ |
| 10 | ○ | x |
| 15 | Δ | x |
| 18 | x | x |

○ = Workable without difficulty.
Δ = Edge or other cracking occurred, but manufacture possible.
x = manufacture impossible in mass production.

TABLE 3

Conditions of manganese dioxide deposition

| Anode surface roughness (Rmax) | Adhesion |
|---|---|
| As rolled | Exfoliation |
| 22 μm | " |
| 83 μm | " |
| 106 μm | Adhesion |
| 325 μm | Good adhesion |
| 981 μm | " |

According to this invention, anodes are formed capable of carrying a far greater current than anodes of titanium alone. They have greater corrosion resistance, too. This invention which produces such anodes with excellent electrode characteristics is of great value in that it provides anodes for the industrial production of electrolytic manganese dioxide.

What is claimed is:

1. An insoluble anode for producing manganese dioxide by electrolysis characterized in that at least a surface layer of said anode is formed from a titanium alloy consisting essentially of from 0.5 to less than 15 percent by weight of nickel, the remainder being titanium and unavoidable impurities, said titanium alloy containing $Ti_2Ni$ particles dispersed therein.

2. An insoluble anode according to claim 1 which has a surface roughness, Rmax, of at least 100 μm.

3. An insoluble anode according to claim 2 which has a flatness of at most 6 mm per meter.

4. An insoluble anode according to claim 2 wherein said titanium alloy forms the entire anode.

5. An insoluble anode according to claim 1 which has a yield strength of at least 30 kgf/mm$^2$ and a Vickers hardness of at least 150.

6. An insoluble anode according to claim 2 which has a yield strength of at least 30 kgf/mm$^2$ and a Vickers hardness of at least 150.

7. An insoluble anode according to claim 5 which has a flatness of at most 6 mm per meter.

8. An insoluble anode according to claim 5 wherein said titanium alloy forms the entire anode.

9. An insoluble anode according to claim 1 which has a flatness of at most 6 mm per meter.

10. An insoluble anode according to claim 9 wherein said titanium alloy forms the entire anode.

11. An insoluble anode according to claim 1 wherein said titanium alloy forms the entire anode.

12. An insoluble anode for producing manganese dioxide by electrolysis characterized in that at least a surface layer of said anode is formed from a titanium alloy consisting essentially of from 0.5 to less than 15 percent by weight of nickel, the remainder being titanium and unavoidable impurities, said titanium alloy having deposited therein $Ti_2Ni$ particles 300 μm or finer in size dispersed uniformly at a rate of at least 10,000 particles per square millimeter of the anode surface area, whereby growth of a passive state film on the anode surface is prevented.

13. An insoluble anode according to claim 12 which has a surface roughness, Rmax, of at least 100 μm.

14. An insoluble anode according to claim 13 which has a yield strength of at least 30 kgf/mm$^2$ and a Vickers hardness of at least 150.

15. An insoluble anode according to claim 13 which has a flatness of at most 6 mm per meter.

16. An insoluble anode according to claim 13 wherein said titanium alloy forms the entire anode.

17. An insoluble anode according to claim 12 which has a yield strength of at least 30 kgf/mm$^2$ and a Vickers hardness of at least 150.

18. An insoluble anode according to claim 17 which has a flatness of at most 6 mm per meter.

19. An insoluble anode according to claim 17 wherein said titanium alloy forms the entire anode.

20. An insoluble anode according to claim 12 which has a flatness of at most 6 mm per meter.

21. An insoluble anode according to claim 20 wherein said titanium alloy forms the entire anode.

22. An insoluble anode according to claim 12 wherein said titanium alloy forms the entire anode.

* * * * *